US005822945A

United States Patent [19]

Muller

[11] Patent Number: 5,822,945

[45] Date of Patent: Oct. 20, 1998

[54] FOLDING TRUSS

[76] Inventor: Roy Muller, 338 Kings Rd., Brisbane, Calif. 94005

[21] Appl. No.: 794,008

[22] Filed: Feb. 3, 1997

[51] Int. Cl.[6] ..... E04H 12/18

[52] U.S. Cl. ..... 52/646; 52/645; 52/690

[58] Field of Search ..... 52/646, 645, 690, 52/692, 652.1, 726.1, 731.1

[56] References Cited

U.S. PATENT DOCUMENTS

| | | | |
|---|---|---|---|
| 1,545,148 | 7/1925 | Lindau | 52/646 X |
| 3,474,579 | 10/1969 | Kieser | 52/645 X |
| 4,620,405 | 11/1986 | Melland | 52/645 |

FOREIGN PATENT DOCUMENTS

| | | | |
|---|---|---|---|
| 600937 | 7/1960 | Canada | 52/645 |
| 2062946 | 7/1971 | Germany | 52/646 |
| 633996 | 11/1978 | U.S.S.R. | 52/645 |

*Primary Examiner*—Robert Canfield

[57] ABSTRACT

A foldable truss comprising three truss cords and webbing connecting two of the three truss cords. The one central truss cord includes hinge segments which allow the truss to occupy a closed position, in which the truss is folded for transport, and an open position, in which the truss is expanded into a stable triangular configuration for supporting objects and/or providing a frame. The present invention may further include various configurations of a bracket for securing the truss in the rigid and stable open position.

20 Claims, 5 Drawing Sheets

FOLDING TRUSS

BACKGROUND OF THE INVENTION

1. Field of the Invention

The present invention relates to truss structures, and in particular to a truss structure which provides rigid structural support when in an open position, and which may be folded into a compact, closed position for easy and inexpensive transport.

2. Description of the Related Art

Public presentations, such as for example trade shows and theatrical or musical performances, typically make use of trusses as support structures for equipment and/or decorative facades. Trusses are conventionally shipped in preassembled sections, and are widely used for temporary constructions due to their relative lightweight and structural stability, and ease with which structures and/or frames may assembled and disassembled therefrom. For example, to construct a trade show booth, the truss sections may be quickly and easily joined to each other in any desired configuration to provide a support for equipment and/or as a frame for the booth. Upon completion of the trade show, the truss structure may then be quickly and easily broken down and transported elsewhere.

An example of a typical truss comprises three elongate rods, referred to herein as truss cords, and webbing attached between the three respective rods to fix the structure in a permanent triangular configuration. Conventional trusses may also have greater than three sides.

A disadvantage to conventional trusses is that they are relatively bulky despite being comprised of relatively few members and little material. This bulk has made trusses difficult and expensive to ship. As trusses are frequently shipped from one location to another, the difficulty and expense of shipment becomes significant. One known prior art system attempting to address this problem is available from Display Structures, Inc., Steamboat Springs, Colo. 80477. That system discloses truss sections which collapse along their length (i.e., the dimension defined by the length of the truss cords) when not in use. However, such a system is practically limited with regard to the length of each truss sections, and alternative, more versatile solutions are needed.

SUMMARY OF THE INVENTION

It is therefore an advantage of the present invention to provide a lightweight and stable truss capable of supporting objects and/or providing a frame for temporary or permanent constructions.

It is a further advantage of the present invention to provide a truss which may be folded into a compact configuration which may be easily and inexpensively transported.

It is a still further advantage of the present invention to provide a truss which may be easily and quickly assembled into a rigid and stable structure, and easily and quickly disassembled and folded into a compact structure.

These and other advantages are accomplished by the present invention which in a preferred embodiment relates to a foldable truss comprising three truss cords and webbing connecting two of the three truss cords. The one central truss cord includes hinge segments which allow the truss to occupy a closed position, in which the truss is folded for transport, and an open position, in which the truss is expanded into a stable triangular configuration for supporting objects and/or providing a frame. The present invention may further include various configurations of a bracket for securing the truss in the rigid and stable open position. Although a preferred embodiment of the invention comprises three sides, the truss according to the present invention may include greater than three sides in alternative embodiments.

BRIEF DESCRIPTION OF THE DRAWINGS

The present invention will now be described with reference to the drawings in which.

DETAILED DESCRIPTION

The present invention will now be described with reference to FIGS. 1–10; which in general relate to a truss capable of folding into a compact configuration which may be easily and inexpensively transported. In a preferred embodiment, the truss may be used for public presentations, such as for example trade shows and theatrical or musical performances. However, it is understood that the present invention is not limited to such public presentations, and may be used in any application for which conventional trusses are presently used. Additionally, although the truss according to the present invention may advantageously be quickly and easily assembled and disassembled, it is understood that the present invention may be used in permanent as well as temporary constructions.

Figure 1:
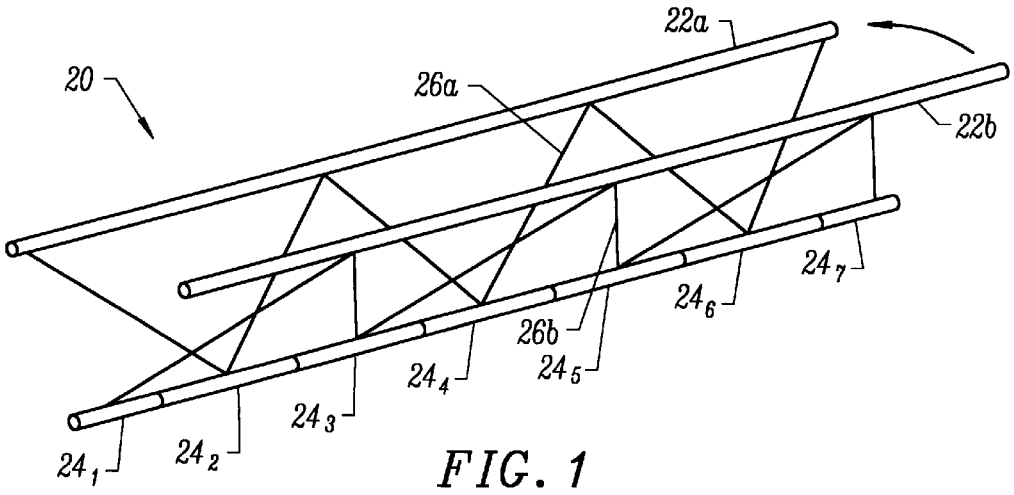
FIG. 1 is a perspective view of a folding truss according to the present invention in an open position.
Figure 2A:
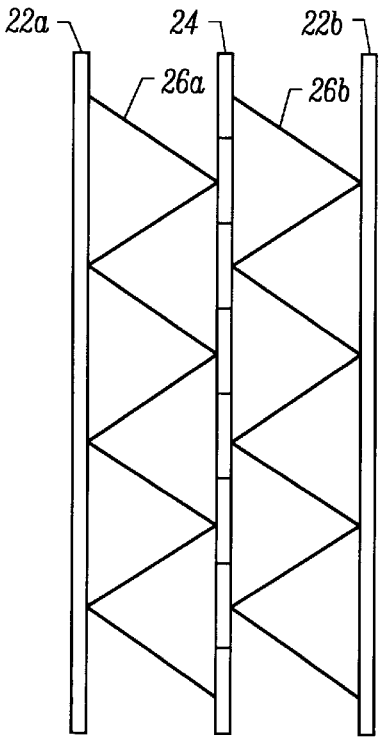
FIG. 2A is a side view of a folding truss according to the present invention.
Figure 2B:
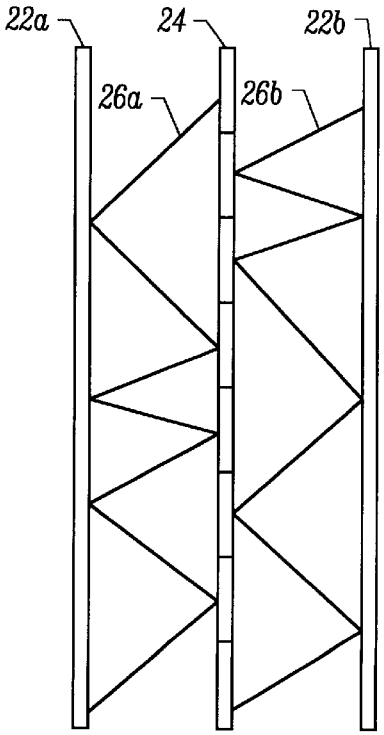
FIG. 2B is a side view of a folding truss according to an alternative embodiment of the present invention.

Referring now to FIGS. 1–2B, there is shown a folding truss 20 comprising a pair of unitary truss cords 22*a* and 22*b* and a central, hinged truss cord 24. Folding truss 20 further includes webbing 26*a* attached between the hinged truss cord 24 and unitary truss cord 22*a*, and webbing 26*b* attached between the hinged truss cord 24 and unitary truss cord 22*b*. Hinged truss cord 24 may be comprised of a plurality of hinge segments, such as for example segments $\mathbf{24}_1$ through $\mathbf{24}_7$. In the embodiment shown in FIGS. 1–2B, each of the even hinge segments ($\mathbf{24}_2$, $\mathbf{24}_4$, and $\mathbf{24}_6$) are coupled to each other via webbing 26*a*. Similarly, each of the odd segments ($\mathbf{24}_1$, $\mathbf{24}_3$, $\mathbf{24}_5$, and $\mathbf{24}_7$) are coupled to each other via webbing 26*b*. It is understood that the number and length of each hinge segment on truss cord 24 may vary in alternative embodiments.

The hinged truss cord 24 preferably includes a hollow center into which is received a pin 28 (FIG. 4), which pin is then suitably fastened within the center of the hinged truss cord 24. For example, once pin 28 is inserted through the center of the hinged truss cord, a hole may be drilled through the hinged truss cord and into the pin 28, and thereafter filled with solder or the like to thereby fasten the hinged truss cord and pin 28 together. The pin may be fastened to the hinged truss cord at more than one location, with the provision that the attachment points are located in hinge segments that are each affixed to webbing 26*a,* or alternatively, in hinge segments that are each affixed to webbing 26*b*. Attached in such a manner, the even hinge segments are capable of rotating with respect to the odd hinge segments along the hinged truss cord 24. In a preferred embodiment, the webbing 26*a* and unitary truss cord 22*a* are attached to the even hinge segments, and the webbing 26*b* and unitary truss cord 22*b* are attached to the odd hinge segments. As webbing 26*a* and webbing 26*b* are never attached to a common hinge segment, the webbing 26*a* and unitary truss cord 22*a* are capable of rotating with respect to webbing 26*b* and unitary truss cord 22*b* about an axis of rotation defined by the hinged truss cord 24.

Although a preferred embodiment of the invention utilizes a pin through the center of the hinged truss cord to provide hinged, rotational movement between the hinge segments, those skilled in the art will appreciate that other known mechanisms may be provided on or between adjacent hinge segments to allow adjacent hinge segments to rotate with respect to each other about a central axis through hinged truss cord 24.

As shown in FIGS. 1 and 2A, in a preferred embodiment of the invention, webbing 26*a* is attached to every other hinge segment, and webbing 26*b* is also attached to every other hinge segment, with no single hinge segment being attached to both webbing 26*a* and 26*b*. In alternative embodiments of the invention, it is understood that the webbing 26*a,* 26*b* may be affixed to the hinged truss cord 24 in configurations other than that shown in FIGS. 1 and 2A. For example, as shown in the alternative embodiment of FIG. 2B, webbing 26*a* or 26*b* may be attached to immediately adjacent segments of the hinge segments $\mathbf{24}_{1-7}$, and the webbing 26*a* or 26*b* may have more than one segment between its attachment points with the hinged truss cord 24. In each alternative configuration, what is required is that no single hinge segment $\mathbf{24}_{1-7}$ be attached to both webbing 26*a* and 26*b*.

Additionally, although a preferred embodiment of the invention illustrates webbing 26*a,* 26*b* as extending diagonally in a zig-zag pattern between the unitary truss cords and the hinged truss cord, those skilled in the art will appreciate that the webbing may attach the unitary truss cords to the hinged truss cord in other ways. For example, the webbing may extend perpendicularly between the unitary truss cords and the hinged truss cord. Other configurations of webbing are contemplated, with the provision that no single hinge segment $\mathbf{24}_{1-7}$ is attached to both webbing 26*a* and 26*b*.

In a preferred embodiment, the unitary truss cords 22*a* and 22*b* and the hinged truss cord 24 are formed of 18 gauge steel tubing having a diameter ranging between one-half inch and three-quarter inches. The webbing 26*a,* 26*b* is preferably formed of steel rods having a diameter ranging between one-eighth inch and one-half inch. It is understood, however, that both the size and type of materials used for the truss cords and webbing may vary in alternative embodiments of the invention. For example, it is understood that the diameter of the truss cords may be less than one-half inch or greater than three-quarter inches, and that the diameter of the webbing may be less than one-eighth inch or greater than one-half inch, in alternative embodiments of the invention. Moreover, it is understood that any of several rigid, high modulus materials may be used instead of steel. For example, aluminum and/or plastic may be used as the truss cords and/or webbing. Further still, although an embodiment of the truss cords utilizes 18 gauge tubing, it is understood that the wall thickness of the tubing may vary in alternative embodiments. Additionally, as opposed to tubing, the truss cords could alternatively be formed of rods having a solid cross-section. Where the truss cords are comprised of a solid cross-section, it may be preferable to use a more lightweight material such as aluminum or plastic.

Figure 3A:
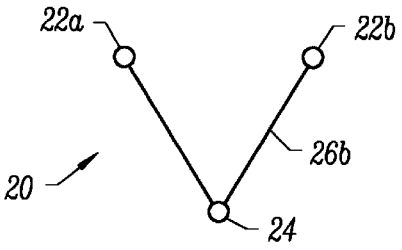
FIGS. 3A and 3B are top views of a folding truss according to the present invention in opened closed positions, respectively.
Figure 3B:
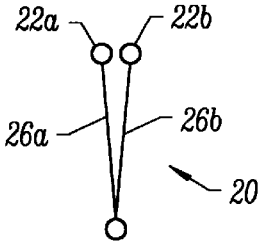
Figure 4:
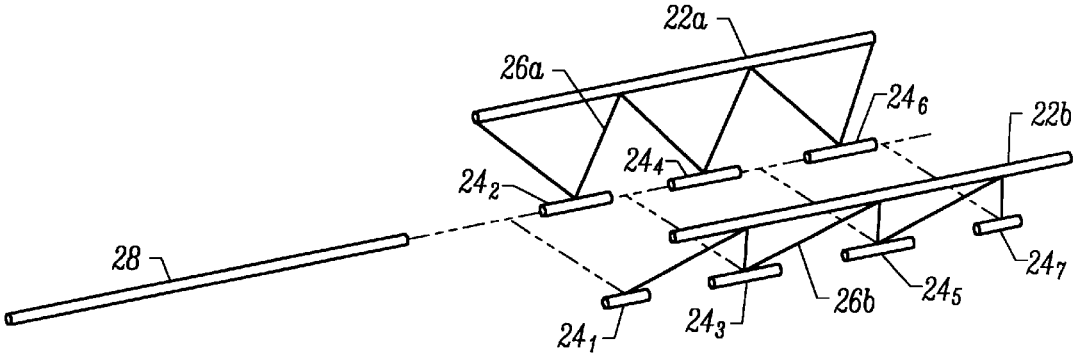
FIG. 4 is an exploded perspective view of a truss according to the present invention.

Referring now to FIGS. 3A and 3B, the hinged configuration of the folding truss 20 as explained above allows the truss 20 to be positioned in an "open position" shown in FIG. 3A, where the truss provides a rigid and stable support structure. The truss 20 may also be folded into a "closed position" shown in FIG. 3B, where the truss has a minimum footprint (i.e., the dimension of the truss viewed from a plane perpendicular to the length of the truss cords). The closed position may be used when the truss is being transported, or otherwise not in use as a structural support.

Figure 5:
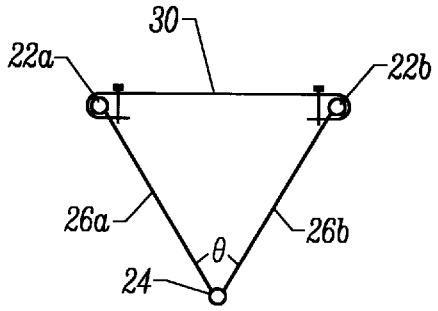
FIG. 5 is a top view of a folding truss also showing a bracket securing the truss in an open position.
Figure 6A:
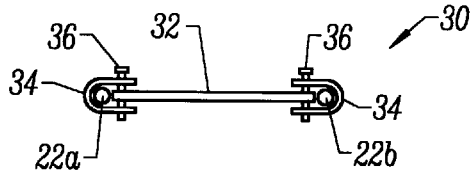
FIGS. 6A–6C are top views of alternative embodiments of brackets for use with the present invention.
Figure 6B:
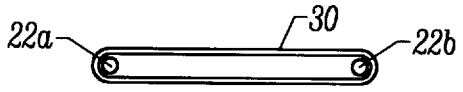
Figure 6C:
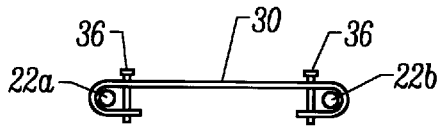

As shown in FIGS. 5–6C, in order to secure the truss 20 in a fixed and repeatable position when in the open position, the present invention may further include a bracket 30 which may be mounted around unitary truss cords 22*a* and 22*b*. In a preferred embodiment, bracket 30 has a length so as to space apart unitary truss cords 22*a* and 22*b* a fixed distance, which distance is substantially equal to the distance between unitary truss cord 22*a* and hinged truss cord 24, and also equal to the distance between unitary truss cord 22*b* and hinged truss cord 24. Thus, in a preferred embodiment, upon fastening of the bracket 30 onto the truss 20, the truss has a footprint substantially forming an equilateral triangle. It is understood that the length of bracket 30 may vary with respect to the distance between unitary truss cords 22*a,* 22*b* and hinged truss cord 24 so as to vary the angle θ. It is further contemplated that the distance separating the unitary truss cord 22*a* from the hinged truss cord 24 may be less than or greater than the distance separating the unitary truss cord 22*b* from the hinged truss cord 24.

Bracket 30 may be formed of the same material as the truss cords and webbing, and, as would be appreciated by those skilled in the art, may have various configurations allowing the bracket to be affixed over the tops or along the lengths of the unitary truss cords. For example, as shown in FIG. 6A, bracket 30 may comprise a bar 32 having holes formed in opposite ends. Bar 32 fits between the unitary truss cords 22*a* and 22*b,* and is affixed thereat by means of shackles 34 and bolts 36. The shackles comprise substantially U-shaped members each having holes in opposite ends, with the bolts 36 fitting through the holes in the shackles 34 and bar 32. Alternatively, as shown in FIG. 6B, bracket 30 may comprise a substantially oblong member having ends which fit around truss cords 22*a* and 22*b* respectively. Further still, as shown in FIG. 6C, bracket 30 may comprise a substantially C-shaped member having aligned holes near the ends, in juxtaposed surfaces of the bracket, for receiving a bolt 36 capable of securing the bracket 30 in position about unitary truss cords 22*a* and 22*b*. As would be appreciated by those skilled in the art, bracket 30 may be formed of other configurations in alternative embodiments of the invention to secure the truss 20 in a fixed position.

Figure 7:
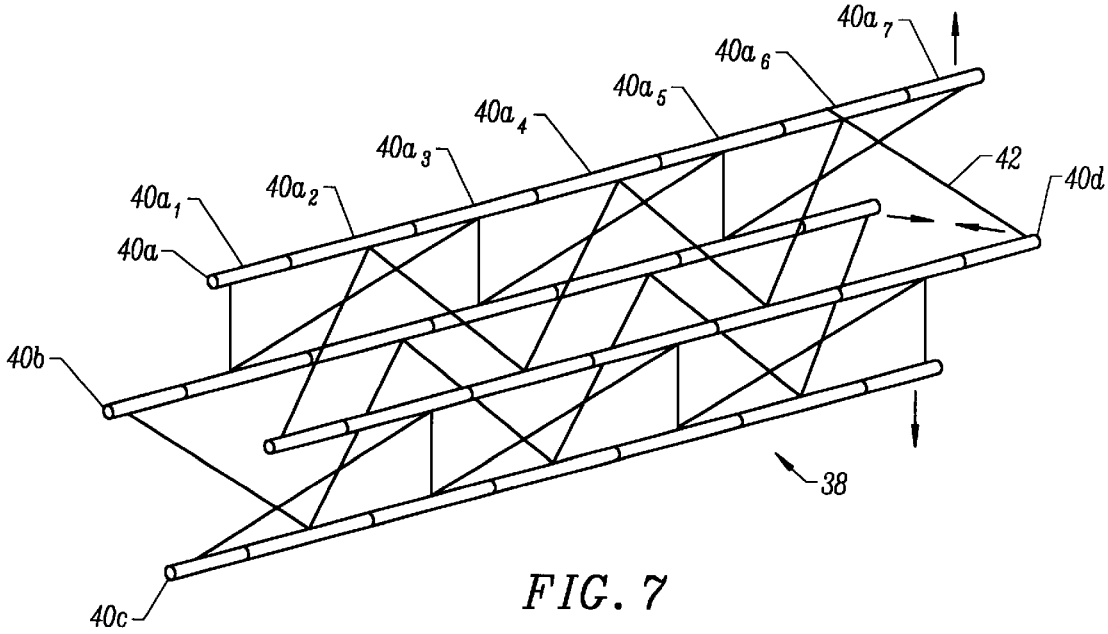
FIG. 7 is a perspective view of a folding truss according to an alternative embodiment of the present invention.
Figure 8A:
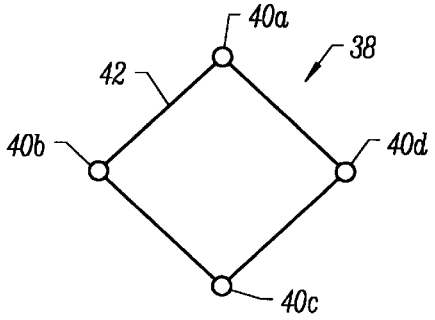
FIGS. 8A and 8B are top views of a folding truss according to the embodiment of FIG. 7 in open and closed positions, respectively.
Figure 8B:
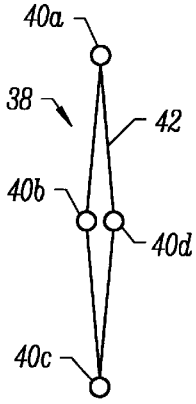
Figure 9:
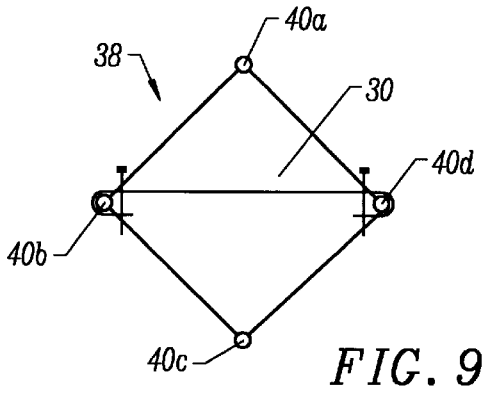
FIG. 9 is a top view of a folding truss according to the embodiment of FIG. 7 showing a bracket securing the truss in an open position.
Figure 10:
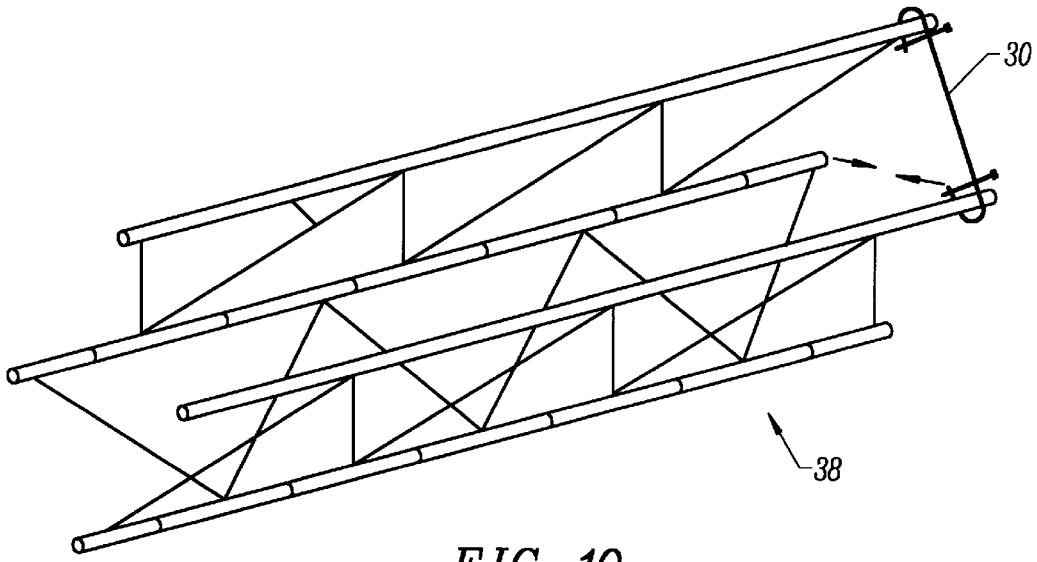
FIG. 10 is a perspective view of a folding truss according to an alternative embodiment of the present invention.

Thus far, a preferred embodiment of the invention has been described as having three sides. However, the present invention may include more than three sides in alternative embodiments. For example, FIGS. 7–8B show a folding truss 38 having four sides. Folding truss 38 preferably includes four hinged truss cords 40*a*–40*d*, with each hinged truss cord 40*a*–40*d* being structurally and operationally identical to hinged truss cord 24 described with reference to FIG. 1. For example, each of the hinged truss cords may include a plurality of hinge segments, for example, segments $\mathbf{40}a_{1-7}$ on cord 40*a*. It is understood that the number and length of each hinge segment may vary in alternative embodiments. Each hinged truss cord is attached to two other hinged truss cords by webbing 42 extending between a given hinged truss cord and the two adjacent hinged truss cords. Webbing 42 may attach between a given hinged truss cord and its two adjacent hinged truss cords in various configurations, with the provision that a segment of the given truss cord is not attached by webbing 42 to both of the truss cords adjacent thereto. Such attachment would prevent folding of the truss 38 according to the present invention. Folding truss 38 is capable of being set up in an open position, where the truss provides a rigid and stable support structure as shown in FIG. 8A. A bracket (30), as shown in FIG. 9 may be affixed to diametrically opposed sides of the open truss to secure the truss in the open position. The truss 38 may also be folded into a closed position where the truss has a minimum footprint. The closed position may be used when the truss is being transported, or otherwise not in use as a structural support.

It is further understood that a folding truss according to the present invention may have greater than four sides in alternative embodiments of the invention. Additionally, the truss according to the invention may include various combinations of unitary and hinged truss cords in alternative embodiments. For example, a further embodiment of the invention may include four truss cords, with two adjacent cords being hinged truss cords as described above, and the remaining two cords being unitary truss cords as described above. In this embodiment shown in FIG. 10, there would preferably be no webbing between the adjacent unitary truss cords. A bracket as described above could be provided over or around the cords. The bracket would preferably be located between the unitary truss cords to fix the truss in an open position. The bracket may be formed of various lengths, to thereby provide the open truss in various configurations. It is also contemplated that the bracket be located between a unitary truss cord and a truss cord not immediately adjacent thereto. This latter construction would fix the truss in an open position, with a truss cord left over, potentially to be joined to a truss cord of an adjacent truss, or some other structure, by a second bracket. As such, several sections of the truss may be fixedly joined side-by-side to each other or some other structure. It is contemplated that any of the folding trusses described above may be joined side-by-side to each other or some other structure by the use of connecting brackets. When not in use, the truss according to the above-described alternative embodiments may be folded into a compact position as described above.

In operation, a truss according to the present invention may be shipped or otherwise transported to a site in its closed position. In a closed position, the truss occupies a minimum of space, thereby facilitating ease and efficiency of transport. Additionally, as volume of a shipped article is generally a factor in determining shipping or transport costs, transporting the truss in a closed position reduces expenses as compared to conventional trusses. Upon reaching the site, the truss may be unfolded, and secured into a rigid and fixed structure by mounting a bracket 30 thereon. As would be appreciated by those skilled in the art, several trusses according to the present invention (each such truss referred to herein as a truss section) may be mounted on top of each other, or side-by-side, to form a truss structure of variable length and size. Each individual truss section may have a length of approximately six feet or smaller, and optimally about three to five feet. However, it is understood that the length of a truss section is not critical to the present invention, and may vary in alternative embodiments. An end of each truss cord may be fit with a pin which protrudes approximately 2–4 inches above the truss cord. These pins are received within and mate with truss cords of an adjacent truss section, so that the truss sections may be stacked on top of each other, or otherwise joined. It is understood that pin 28 through the center of hinged truss cord 24 may protrude above the top of truss cord 24 to serve as such a stacking pin. It is further contemplated that truss sections according to the present invention may be used with conventional trusses. When it is time to disassemble the truss structure, the individual truss sections may be separated from each other, the brackets removed, and the trusses folded into a closed position for transport to the next site.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

I claim:

1. A truss, comprising:

a plurality of truss cords;

a hinge provided on at least one truss cord of said plurality of truss cords, said at least one truss cord having a plurality of hinge segments and a hollow center throughout;

a pin inserted through said hollow center, said pin being attached to a first group of hinge segments from said plurality of segments, such that said first group of hinge segments is capable of rotating with respect to a second group of hinge segments of said plurality of hinge segments, said first group of hinge segments being different than said second group of hinge segments;

a first connector connecting said at least one truss cord with a second truss cord of said plurality of truss cords, said first connector connecting to said first group of hinge segments; and a second connector connecting said at least one truss cord with a third truss cord of said plurality of truss cords, said second connector connecting to said second group of hinge segments.

2. A folding truss, comprising:

a plurality of truss cords;

a hinge provided on at least one truss cord of said plurality of truss cords, said at least one truss cord having a plurality of hinge segments and a hollow center throughout;

a pin inserted through said hollow center, said pin being attached to a first group of hinge segments from said plurality of hinge segments, such that said first group of hinge segments is capable of rotating with respect to a second group of hinge segments of said plurality of hinge segments, said first group of hinge segments being different than said second group of hinge segments;

a first connector connecting said at least one truss cord with a second truss cord of said plurality of truss cords, said first connector connecting to said first group of hinge segments;

a second connector connecting said at least one truss cord with a third truss cord of said plurality of truss cords, said second connector connecting to said second group of hinge segments;

wherein the folding truss is capable of occupying a first position where said second and third truss cords are substantially spaced from each other, and wherein the folding truss is capable of occupying a second position where said second and third truss cords are substantially adjacent to each other, said hinge permitting movement of the folding truss between said first and second positions.

3. A folding truss as recited in claim 2, further comprising a bracket mounted around said second truss cord and said third truss cord for securing the folding truss in said first position.

4. A folding truss as recited in claim 2, wherein said plurality of truss cords comprise three truss cords.

5. A folding truss as recited in claim 2, wherein said plurality of truss cords comprise four truss cords having a first pair of diametrically opposed truss cords and a second pair of diametrically opposed truss cords with a footprint substantially forming a parallelogram.

6. A folding truss as recited in claim 2, wherein the plurality of truss cords are made of steel.

7. A folding truss as recited in claim 2, wherein the plurality of truss cords are made of aluminum.

8. A folding truss as recited in claim 2, wherein the plurality of truss cords are made of plastic.

9. A folding truss as recited in claim 1, wherein said first connector comprises webbing extending between said first group of hinge segments and said second truss cord.

10. A folding truss as recited in claim 1, wherein said second connector comprises webbing extending between said second group of hinge segments and said third truss cord.

11. A folding truss as recited in claim 1, wherein said first group of hinge segments comprises odd hinge segments of said plurality of hinge segments, odd hinge segments being every other hinge segment starting with a first hinge segment at one end of said at least one truss cord.

12. A folding truss as recited in claim 11, wherein said second group of hinge segments comprises even hinge segments of said plurality of hinge segments, even hinge segments being every other hinge segment starting with a second hinge segment immediately adjacent said first hinge segment at said end of said at least one truss cord.

13. A folding truss as recited in claim 3, wherein said bracket comprises a bar member matingly connected to said second truss cord and said third truss cord by an affixing member on each end of said bar member.

14. A folding truss as recited in claim 3, wherein said bracket comprises an oblong member having ends which fit around said second truss cord and said third truss cord.

15. A folding truss as recited in claim 3, wherein said bracket comprises a substantially C-shaped member matingly connected to said second truss cord and said third truss cord by an affixing member on each end of said substantially C-shaped member.

16. A folding truss as recited in claim 5, further comprising a bracket for securing the folding truss in said first position.

17. A folding truss as recited in claim 5, wherein said bracket is affixed to diametrically opposed sides of the folding truss in said first position.

18. A folding truss, comprising:

a plurality of truss cords, said plurality of truss cords having a footprint substantially forming a parallelogram;

a hinge provided on at least two truss cords of said plurality of truss cords, said at least two truss cords having a plurality of hinge segments and being immediately adjacent to each other;

said at least two truss cords having said plurality of hinge segments including a first group of hinge segments and a second group of hinge segments, wherein said first group of hinge segments comprises odd hinge segments, said odd hinge segments being every other hinge segment starting with a first hinge segment at one end of at least two truss cords, and said second group of hinge segments comprises even hinge segments, said even hinge segments being every other hinge segment starting with a second hinge segment immediately adjacent said first hinge segment at said end of said at least two truss cords;

a first connector connecting a first hinge truss cord of said at least two truss cords having said plurality of hinge segments and a second hinge truss cord of said at least two truss cords having said plurality of hinge segments, said first connector connecting to said first group of hinge segments on said first hinge truss cord and connecting to said second group of hinge segments on said second hinge truss cord;

a second connector connecting said first hinge truss cord to a third truss cord of said plurality of truss cords; and a third connector for connecting said second hinge truss cord to a fourth truss cord of said plurality of truss cords.

19. A folding truss as recited in claim 18, wherein a bracket is mounted around said third truss cord and said fourth truss cord of said plurality of truss cords in an open position.

20. A folding truss, comprising:

a plurality of truss cords;

a hinge provided on at least one truss cord of said plurality of truss cords, said at least one truss cord having a plurality of hinge segments;

a first connector connecting said at least one truss cord with a second truss cord of said plurality of truss cords, said first connector connecting to a first hinge segment at one end of said at least one truss cord and skipping at least two hinge segments, then connecting at least two consecutive hinge segments;

a second connector connecting said at least one truss cord with a third truss cord of said plurality of truss cords, said second connector connecting to a second hinge segment immediately adjacent said first hinge segment at said end of said at least one truss cord and connecting a next hinge segment immediately adjacent said second hinge segment, and skipping at least two hinge segments;

wherein no single hinge segment is attached to both said first connector and said second connector, and wherein the folding truss is capable of occupying a first position where said second and third truss cords are substantially spaced from each other, and wherein the folding truss is capable of occupying a second position where said second and third truss cords are substantially adjacent to each other, said hinge permitting movement of the folding truss between said first and second positions.

* * * * *